United States Patent [19]

Djordjevic et al.

[11] Patent Number: 4,479,474

[45] Date of Patent: Oct. 30, 1984

[54] RPM GOVERNOR FOR FUEL-INJECTED INTERNAL COMBUSTION ENGINES, IN PARTICULAR A FINAL IDLING RPM GOVERNOR OF AN INJECTION PUMP FOR DIESEL VEHICLE ENGINES

[75] Inventors: Ilija Djordjevic; Werner Brühmann; Ernst Ritter; Hansjörg Frey, all of Stuttgart, Fed. Rep. of Germany

[73] Assignee: Robert Bosch GmbH, Stuttgart, Fed. Rep. of Germany

[21] Appl. No.: 392,501

[22] Filed: Jun. 28, 1982

[30] Foreign Application Priority Data

Aug. 6, 1981 [DE] Fed. Rep. of Germany ..... 3131131

[51] Int. Cl.[3] ..... F02D 1/04

[52] U.S. Cl. ..... 123/373; 123/179 L; 123/365

[58] Field of Search ..... 123/179 L, 339, 373, 123/374, 368, 371, 364, 365

[56] References Cited

U.S. PATENT DOCUMENTS 3,759,236 9/1973 Staudt et al. ..... 123/140 R
3,830,211 8/1974 Bechstein ..... 123/373
4,109,627 8/1978 Uchino ..... 123/373
4,286,558 9/1981 Djordjevic ..... 123/373
4,397,277 8/1983 Takahashi ..... 123/373

*Primary Examiner*—Charles J. Myhre
*Assistant Examiner*—Carl Stuart Miller
*Attorney, Agent, or Firm*—Edwin E. Greigg

[57] ABSTRACT

The governor (FIG. 1) includes a second idling spring (supplementary idling spring 42) secured on a force transmission lever (31) acted upon by the main governor spring (34). By means of the second idling spring, the restoring force of a first idling spring (38) on a portion of the idling sleeve path (a) is reinforced in the idling position of an adjusting member (22). This exertion of force on the part of at least the supplementary idling spring (42) is increased in accordance with load by means of a corrective adjusting member (44) when the adjusting member (22) has pivoted into a partial-load position. As a result, in order to improve the starting behavior even in minimum-maximum speed governors, a partial-load rpm located above the idling rpm can be regulated, and a progressively increased supply quantity is controlled at the associated injection pump with increasing load in the lower partial-load range.

12 Claims, 5 Drawing Figures

R
A
B
C
50°
K
L
D
Rv
F
G
40°
C
He
d'
30°
He'
d
e'
20°
LL
H
Ie
Ie'
e
10°
I
J
E
n1
nZ1
nZ2
n

R
A
B
Bf
Gn
C
50°
K
L
D
Rv
f''
40°
F
G
f'
f
g'
30°
Hh
Hh'
g
h'
LL
20°
H
Ih
h
Ih'
10°
I
J
nZ1
nZ2
n

RPM GOVERNOR FOR FUEL-INJECTED INTERNAL COMBUSTION ENGINES, IN PARTICULAR A FINAL IDLING RPM GOVERNOR OF AN INJECTION PUMP FOR DIESEL VEHICLE ENGINES

BACKGROUND OF THE INVENTION

The invention is based on an rpm governor for fuel-injected internal combustion engines as disclosed hereinafter. A centrifugal rpm governor of this type is already known from German Offenlegungsschrift No. 29 00 198, in which by means of using a second idling spring, a so-called supplementary idling spring, the regulation of idling is stabilized. The first idling spring is designed such that a sufficiently great load can be accepted, and by means of the supplementary idling spring, the P degree, i.e., degree of proportionality, is increased in the direction of higher rpm, so that the engine operation is anticipated when there is a rapid drop in load and accordingly does not stall. By disposing both springs which affect idling on the force transmission lever, their force is automatically excluded from having any effect after the idling sleeve path has been traversed; as a result, these springs advantageously do not influence the characteristic curves for the shut-off of regulation. Since the known rpm governor serves as a minimum-maximum speed governor of an injection pump for Diesel vehicle engines, then when the engine starts while the operating lever is in the full-load position, the supplementary idling spring would displace the breakaway point for regulation of the starting quantity in the direction of an increased rpm because of the increased P degree. This would normally cause the emission of smoke, although this is avoided because the force of the supplementary idling spring is reduceable in accordance with the pivoted position of the adjusting member. In addition, in the known rpm governor, in which a guide lever supported on the axis of rotation of the force transmission lever and connected with the regulating member can be coupled via a connecting member with one end of the supplementary idling spring, which is supported on its other end on the force transmission lever, a puller screw is attached to the adjusting member; by means of this screw, the exertion of force by the supplementary idling spring is precluded when the engine is starting while the adjusting member is in the full-load position.

In governors of the type described above, weak starting occurs despite the improved regulation of idling, caused by the relatively small increase in fuel quantity while the adjusting member is pivoted out of the idling position. Because there is no regulated stage between the idling rpm and the final rpm, the danger exists that when there is great drive resistance, such as shifting into a lower gear while going uphill, the engine will run up as far as the full-load rpm, which causes greater wear on the clutch, among other effects.

OBJECT AND SUMMARY OF THE INVENTION

The rpm governor according to the invention has the advantage over the prior art that the running-in behavior of the engine is improved by means of the corrective adjusting member actuatable by the adjusting member, when the adjusting member is pivoted out of the idling position into a partial-load position. By means of the load-dependent inclusion of a so-called "regulated partial-load rpm stage", the disadvantageous revving up of the engine to rated rpm while shifting into gear uphill is prevented, thus resulting in reduced clutch wear. Furthermore, a greater increase in the governor path can be attained without building in a variable translation member in the range of small adjusting lever angles, which substantially improves starting comfort without increasing the tendency to jerking.

Advantageous improvements of and further embodiments of the rpm governor disclosed in the main claim are possible by means of the characteristics disclosed in the dependent claims. Thus, because the initial stressing force of the first idling spring is increased by means of the characteristics of the claims 2, 3 or 4, together with the characteristic curve of the first idling spring, that of the second idling spring is also displaced in the direction of a higher supplemental rpm $n_Z$, as may be learned from the diagram of FIG. 5.

If the rpm governor according to the invention is provided with the characteristics included in the expanded preamble to claim 5 and also known from the document discussed above, then in accordance with the novel characteristics of claim 5, the desired progressive increase in load is brought about by means of the second idling spring, which is displaced in accordance with load in the direction of a higher supplemental rpm, without shifting the range of the first idling spring, which also contributes to influencing the increased starting quantity, excessively far in the direction of an increased rpm. By means of the characteristics of claims 6 and 7, the regulator can be attained with only a few new parts and can thus be manufactured at a favorable cost. By means of the characteristics of claim 8, an improved guidance of the corrective adjusting member is attained. In an rpm governor embodied in accordance with claim 9, whose characteristics recited in the expanded preamble are likewise known from the document discussed above, the characteristics recited in the novelty portion of the claim mean that the supplemental rpm of the second idling spring can be fixed precisely and restricted to a specific pivoting range of the adjusting member. Thus, it is possible to restrict the progressive increase in the regulated path of the additionally regulated partial-load rpm to an rpm range below that rpm at which the engine become loud and tends to "buck".

By means of the control slot recited in the novelty portion of claim 10 and by means of the various control sections recited in claims 11 and 12, the control characteristic of the rpm governor embodied in accordance with the invention can be adapted within wide limits to the specifics of a particular engine.

Particularly by means of the characteristics of claim 12, unfavorable influence on the shut-off of regulation for the starting quantity is prevented by means of the second idling spring, thus preventing an increase in the emission of smoke.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
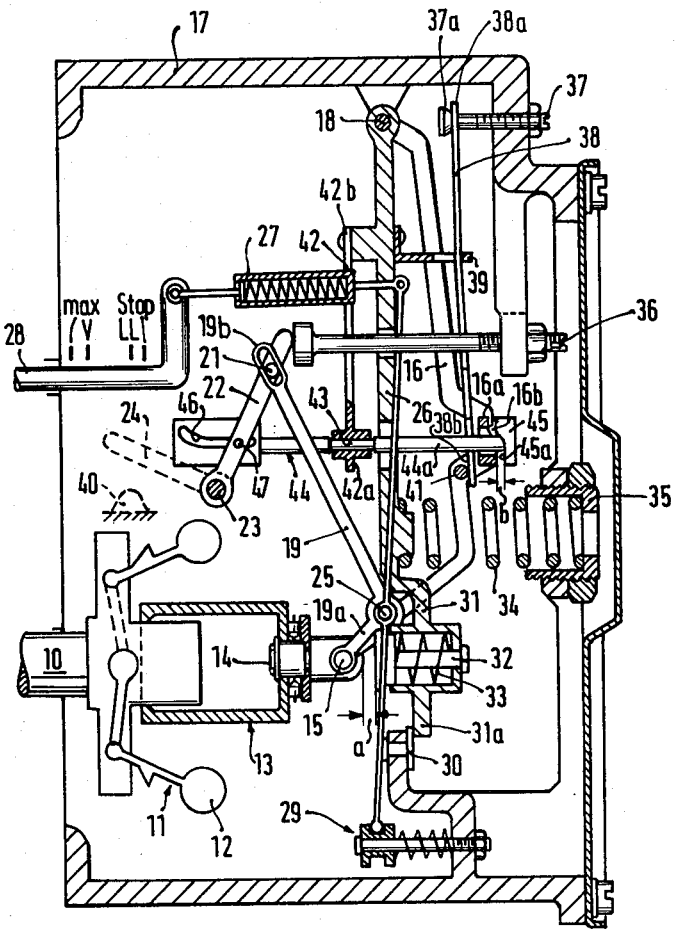
FIG. 1 is a simplified cross sectional illustration taken through the first exemplary embodiment.

In the first exemplary embodiment, shown in simplified form in FIG. 1, of a centrifugal rpm governor embodied as a minimum-maximum speed governor, a flyweight governor 11 is secured on a cam shaft 10 of an injection pump for internal combustion engines, which is known and not shown otherwise. The flyweights 12 of this governor 11, which are supported in pivotable manner, transmit the pivotal path effected by centrifugal force in the form of a sleeve stroke onto a governor sleeve 13, which serves as the regulating member, and its sleeve bolt 14. The sleeve bolt 14 is articulated by means of a bearing tang 15 to a guide lever 16, which is pivotable on a rotary axis 18 secured in the governor housing 17 and thus guides the governor sleeve 13 in the course of its stroke movements. Furthermore, one end 19a of a deflection lever 19 is connected in an articulated manner by means of the bearing tang 15 with the sleeve bolt 14 of the governor sleeve 13, and another end 19b of this deflection lever 19 is connected in an articulated manner via a pin 21 with a lever-like adjusting member 22. The adjusting member 22 is secured on a lever shaft 23 supported in the governor housing 17 and serves as the pivotal axis, the lever shaft 23 furthermore is arrange to carry an operating lever 24 shown in broken lines and located outside the governor housing 17. The deflection lever 19 is connected via a bearing point 25 located between its two ends 19a and 19b with a governor lever 26, which on one end is articulated via a yielding strap 27 to a governor rod 28 acting as the supply quantity adjusting member of the injection pump and is supported on the other end on an adjustable pivotal bearing 29.

In addition to the guide lever 16, a force transmission lever 31 is supported on the rotary axis 18, in which an adaptation bolt 32 serving as the stroke stop for the sleeve bolt 14 is displaceably guided counter to the force of an adaptation spring 33 and which is forced with its free end 31a against a stop 30 which is attached to the housing by a main governor spring 34. The initial stressing force of the main governor spring 34 serving as a maximum-rpm regulating spring is determined by the position of installation and can be adjusted by means of an abutment 35 embodied by a threaded sheath and threadedly inserted into the governor housing 17. An idling stop 36 embodied as a stop screw and intended for the adjusting member 22 is disposed inside the governor housing 17 and fixes the illustrated idling position of the adjusting member 22 and also of the operating lever 24 located outside the governor housing 17, while the starting and full-load position is determined by a full-load stop 40 indicated by broken lines.

A head 37*a*, located inside the governor housing 17, of an adjusting screw 37 serves as the adjustable abutment for one end 38*a* of a first idling spring 38 embodied as a leaf spring, the idling spring being supported on a force transmission lever 31 via a support bracket 39 serving as a fixed support bearing or as a resting place, and with its other end 38*b*, in the opposite direction from the abutment 37*a*, presses against a transverse bolt 41 of the guide lever 16.

A second idling spring 42 embodied as a leaf spring and also called the supplementary idling spring is secured on the force transmission lever 31. One end 42*a* of the second idling spring 42 receives a substantially bolt-like corrective adjusting member 44 in a bearing bore 43 extending approximately parallel to the rotary axis of the cam shaft and disposed at right angles to the longitudinal extension thereof. The corrective adjusting member 44 is guided rotatably inside the bearing bore 43, and is positively secured against axial displacement. A portion 44*a* of the corrective adjusting member 44 serves as a connecting member between the second idling spring 42 and the guide lever 16. To this end, the guide lever 16 is provided with a coupler part 16*a*, which is perforated and receives the portion 44*a*, and a stop member 45 secured to the connecting portion 44*a* comes to rest against this coupler part 16*a* after transversing a distance b. In the illustrated exemplary embodiment, both the coupler part 16*a* which serves as the counterpart stop for the stop member 45 and the stop member 45 itself are each provided with a stop curve 16*b* or 45*a*, respectively. The shaping of these curves 16*b* and 45*a* is designed such that upon the rotation of the corrective adjusting member 44, the distance b varies, as a result of which the supplemental rpm $n_Z$ of the second idling spring 42, which will be described in connection with FIG. 4 below, can be fixed with reference to the position of the adjusting lever. (The distance b is not to scale in the drawing, being shown as larger than actual size for the sake of clarity.) In order to cause the rotary movement of the corrective adjusting member 44, the corrective adjusting member 44 is provided on its end remote from the stop member 45 with a control slot 46 in the form of an oblong slot, which is engaged by a coupler member 47, which is secured to the adjusting member 22. The control slot 46, which is embodied in curved form, by its shaping determines the effective range of the second idling spring 42 with respect to the load-dependent pivoted position of the adjusting member 22. A specialized embodiment of this control slot 26 will be described in greater detail below in connection with FIG. 2, where despite a different bearing of the corrective adjusting member 44 this control slot 46 has approximately the same shape.

Figure 2:
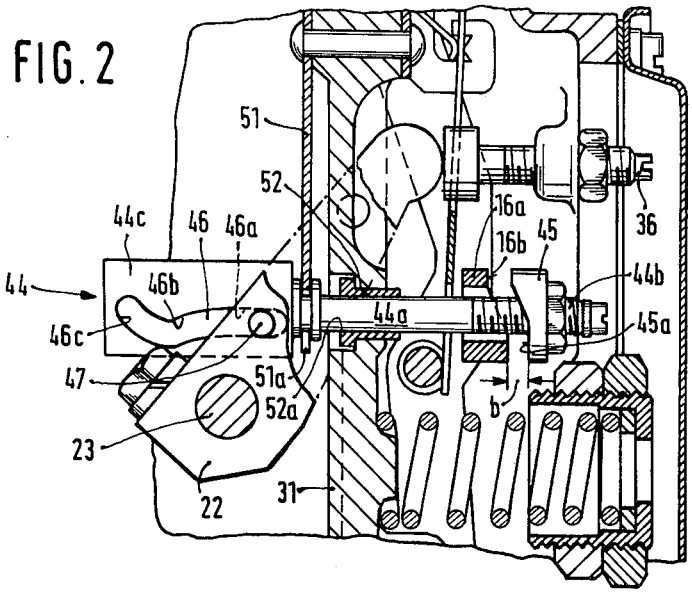
FIG. 2 is a partial cross section through the second exemplary embodiment, containing only those characteristics essential to the invention.

FIG. 2 shows the portion of a second but practically embodied example which is essential to the invention. Here, a supplementary idling spring 51 acting as the second idling spring forms with one slotted end 51*a* only an axial bearing for the corrective adjusting member 44, whose shaft-like part 44*a*, serving as the connecting member, is supported both rotatably and axially displaceably within a guide bore 52*a* of a bearing bushing 52 in the force transmission lever 31. The shaft-like part 44*a* of the corrective adjusting member 44, on its end 44*b*, which is provided with a thread, carries a stop member 45 provided with a stop curve 45*a* and is embodied as an elastic stop nut. It is also very clear from this drawing that the stop curve 16*b* on the coupler part 16*a* corresponds with the stop curve 45*a* on the stop member 45. In a reinforced head part 44*c* of the corrective adjusting member 44, the control slot 46 is accommodated; in the illustrated embodiment, this control slot 46 has three control sections 46*a*, 46*b* and 46*c* which affect the effective range of the second idling spring 51. The first control section 46*a* shifts the effective range of the second idling spring 51 in the direction of an increased supplemental rpm $n_Z$ if the adjusting member 22 is pivoted in a counterclockwise direction out of the idling position shown, which is fixed by the idling stop 36, into a partial-load position. By means of the second, arc-shaped control section 46*b*, the supplemental rpm $n_Z$ is held at least approximately constant in a further pivotal range of the adjusting member 22; and the third control section 46*c* causes the rotational movement of the corrective adjusting member 44 when the adjusting member 22 has been pivoted into the full-load position, to be restored at least as far back as the idling position, and even better, below this position. As a result, the exertion of force by the supplementary idling spring 51 can be reduced or entirely precluded in the full-load position, as is accomplished in the subject of the German Offenlegungsschrift No. 29 00 198, described above, by means of the additional puller screw secured to the adjusting member.

Figure 3:
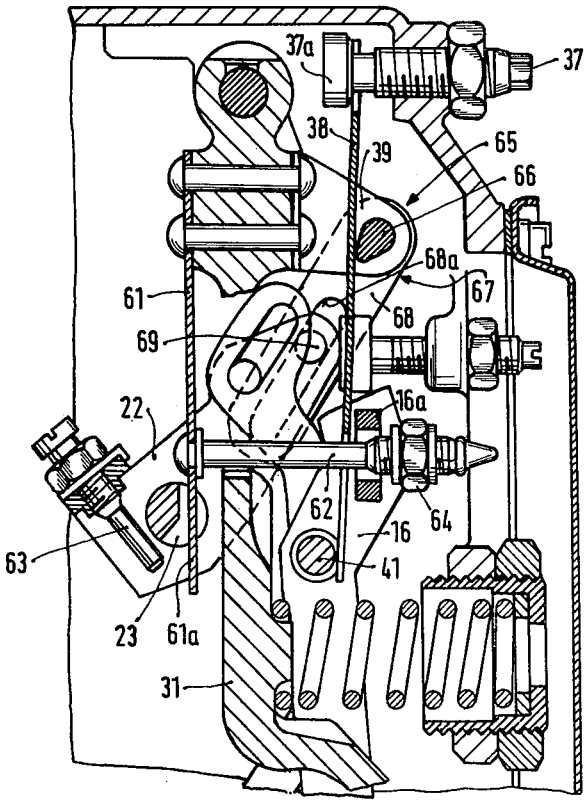
FIG. 3 is a partial cross section of the third exemplary embodiment, corresponding to FIG. 2.

FIG. 3 shows the portion of the practically embodied third exemplary embodiment which is essential to the invention, in which elements adopted from FIGS. 1 and 2 and functioning identically are also identified by the same reference numerals. At the level at which the support bracket 39 for the first idling spring 58 is secured to the force transmission lever 31, a supplementary idling spring 61 acting as the second idling spring is also secured. In the present case, this supplementary idling spring 61 is riveted together with the support bracket 39 to the force transmission lever 31. In the vicinity of one end 61*a* the supplementary idling spring 61 is provided with a connecting bolt 62, and this end 61*a* is actuated by a puller screw 63 secured to the adjusting member 22 whenever the adjusting member 22 is in the full-load position (not shown in FIG. 3) and thus puts the supplementary idling spring 61 out of operation. These characteristics correspond precisely to the primary characteristics of German Offenlegungsschrift No. 29 00 198 discussed above as prior art and, together with an adjusting nut fixed on the connecting bolt 62 in the illustrated position and acting as a stop, they serve to put the supplementary spring 61 out of action in the full-load range.

Differing from the exemplary embodiments discussed above in connection with FIGS. 1 and 2, in the third exemplary embodiment shown in FIG. 3 a corrective adjusting member 65 actuated by the adjusting member 22 is substantially embodied by an adjusting cam 66 supported on the force transmission lever 31. The adjusting cam 66 is rotatably supported in the support bracket 39 and coupled via a connecting link 67 with the adjusting member 22; as a result, when the adjusting member 22 has pivoted out of the illustrated idling position into a partial-load position, the adjusting cam 66 is adjustable in order to increase the spring prestressing force of the first idling spring 38. The connecting link 67 comprises an adjusting lever 68 connected in a rotationally fixed member with the adjusting cam 66, and the lever 68 has an oblong slot guide 68*a*, which is shown in broken lines for the most part, being located behind the guide lever 16 and the adjusting member 22, and is engaged by a guide pin 69 secured on the adjusting member 22. By means of the guide pin 69 of the adjusting member 22 which belongs to the connecting link 67 and engages the oblong slot guide 68*a* of the adjusting lever 68, then in accordance with the invention when the adjusting member is pivoted out of the illustrated idling position into a partial-load position, the adjusting cam 66 of the corrective adjusting member 65 rotates in order to increase the spring prestressing force of the first idling spring 38. Thus, as described in greater detail below in connection with FIG. 5, the characteristic curve of the first idling spring 38 and thus of the second idling spring 61 as well are shifted in the direction of higher rpm and for increasing the associated supply quantity.

Figure 4:
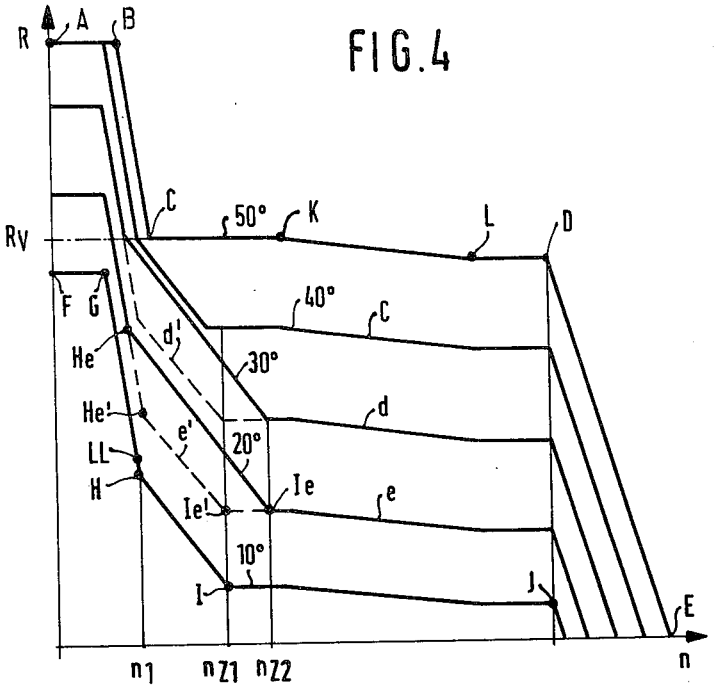
FIGS. 4 and 5 are each a diagram showing regulating curves of the governor according to the invention.
Figure 5:
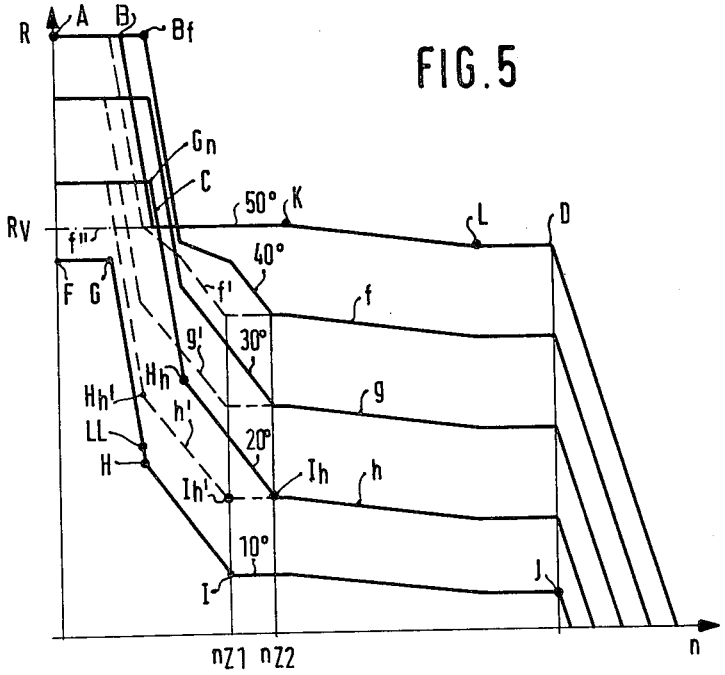

Various regulating curves of the governor according to the invention are plotted in the diagrams according to FIGS. 4 and 5. On the ordinate, the path R of the regulating rod 28 is plotted, while the rpm n is plotted in the abscissa. A curve indicated by solid lines A-B-C-D-E represents the full-load regulating curve, and the curve F-G-H-I-J represents the corresponding idling regulating curve, the curve segment H-I provided with the larger P degree being brought about as a result of the influence of the supplementary idling spring 42 or 51. The angular data located beside these curves indicate the associated various angular positions of the adjusting member, measured with respect to its stop position. The partial-load curve c, d and e or f, g and h plotted in the diagram show in their solid-line portions the course of supply quantity attained by the invention and represented by the associated regulated path R over the rpm n, while the associated curved parts d', e', f', g', h' indicated by broken lines, represent the course of the regulated path attainable without the characteristics according to the invention.

The curved part K-L of the full-load regulating curve shown in FIGS. 4 and 5 is controlled by means of the adaptation bolt 32 (see FIG. 1) which serves as the stroke stop for the governor sleeve 13 and loaded by the adaptation spring 33, and serves in a known manner to adapt the supply quantity; however, this is not the subject of the present invention. The remaining details of the described diagrams will be discussed more extensively below in connection with the functioning of the apparatus.

The mode of operation of the three exemplary embodiments according to the invention and shown in FIGS. 1–3 will now be described in greater detail with respect to various operational stages, and the corresponding operational points of the regulating curve thereby traced will be taken from FIGS. 4 and 5 or are expanded in these figures.

With the exception of the supporting of the corrective adjusting member 44, the mode of operation of the two exemplary embodiments shown in FIGS. 1 and 2 is the same and will thus be discussed together, referring to the associated diagrams of FIG. 4. In both exemplary embodiments, the adjusting member 22 is in its idling position in which it rests on the idling stop 36. The flyweights 12 are pivoted outward partway and have displaced the governor sleeve 13 out of the outset and starting position in the direction toward the force transmission lever 31, so that in the illustrated idling position only a portion of an idling sleeve path a, serving the purpose of idling regulation, determines the distance from the adaptation bolt 32. The governor rod 28 is thus in its idling position indicated by the symbol LL in FIG. 1, which is indicated in FIG. 4 near point H, and the associated idling rpm corresponds approximately to the rpm $n_1$. The more steeply inclined curve section G-H is controlled by the first idling spring 38; the flatter curved section H-I between the rpms $n_1$ and $n_Z1$ is controlled by the supplementary idling spring 42 or 51. The symbol $n_Z1$ here indicates the switch-in rpm at which the supplementary idling spring 42, 51 is switched into operation, because in this case the exertion of force on the part of this supplementary idling spring 42, 51 begins with a decreasing rpm.

Now if the adjusting member 22 is pivoted out of the idling position indicated at 10° into the 20° position, during acceleration, then the associated governor rod position would be lifted accordingly, and the regulated path R traversed by the regulator rod 28 would follow up the curve course e' up to $n_Z1$ if as in FIG. 3 the adjusting member 22 were to exert no influence on the prestressing of the supplementary idling spring 42, 51. The associated increase in supply quantity or the increase in the length of the regulated path plotted on the ordinate of FIG. 4 is relatively small, which is disadvantageous. However, since with the adjusting member 22 pivoted out of the illustrated idling position the coupler member 47 connected with it has rotated the corrective adjusting member 44 by way of the control slot 46 located on the corrective adjusting member 44, the distance between the stop curves 16*a* and 45*a* has also been reduced; as a result, the supplemental rpm of the supplementary idling spring 42, 51 was increased from $n_Z1$ to $n_Z2$. Thus the curved portion indicated by the symbol $H_e'$-$I_e'$ indicated in the curved section e' has become the curved section $H_e$-$H_e$ in the partial-load curve e. In accordance with the invention, the supplemental rpm of the idling spring 42, 51 has been increased by the curve section $H_e$-$I_e$ in accordance with the invention, and simultaneously the regulated path R determining the supply quantity and associated therewith has been lengthened. This lifting of the curved part controlled by the supplementary idling spring 42, 51 has the effect that the governor controls a substantially quicker increase in fuel quantity, which is advantageous in acceleration; simultaneously, the regulatable range has been increased up to $n_Z2$. This increase could also be shifted in the direction of a higher supplemental rpm, with a corresponding shaping of the control slot 46, even in the case of a further pivoting of the adjusting member 22; however, it has proved to be advantageous not to undertake any further increase in the initial stressing force of the supplementary idling spring 42, 51 in the further adjustment range, for instance, above the 20° position. To this end, the control section 46*b* is embodied, as may be clearly seen in FIG. 2, such that the supplemental rpm $n_Z2$ is held constant.

On the last portion of the pivotal path, in which the adjusting member 22 approaches the 50° or full-load position, the rotary movement previously effected by the control section 46*a* is set back once again by means of the control section indicated as 46*c* in FIG. 2, in fact to an even greater distance b, so that the 40° position of the adjusting member 22 (see curve c) the supplemental rpm of the supplementary idling spring is shifted from $n_Z1$ in the direction toward $n_1$, and is taken completely out of action in the full-load position.

In the third exemplary embodiment shown in FIG. 3, as may be seen from FIG. 5, the initial stress of the first idling spring 38 is increased by the corrective adjusting member 65, for instance with the adjusting member 22 pivoted into the 20° partial-load position, and together with the associated curve section $G_h$-$H_h$, the curve section associated with the supplementary idling spring 61 and plotted as $H_h'$-$I_h'$ in the original partial-load curve h' also shifts in accordance with the invention following $H_h$-$I_h$ in the partial-load curve h. Thus, as in the exemplary embodiments described previously, here again a substantial increase in supply quantity and rpm is preprogrammed, controlling the required increase in supply quantity for improved starting behavior.

If the increase in the starting quantity shut-off rpm plotted above the full-load regulated path $R_V$ from B following $B_f$ in the 40° position of the adjusting member 22, corresponding to curve f, has a disruptive influence, then by means not described in greater detail here, but known, the increased starting quantity for this adjusting lever path can be cut off completely, which is indicated in the drawing by a horizontal curve section f'' at the level of $R_V$ in dotlines.

In FIGS. 1 and 2, the distance b of the stop curves 16*b* and 45*a* has been shown in greater than actual size in order to show the functioning more clearly; this distance is approximately equal to the distance which the associated parts assume with respect to one another in the position of rest or outset position of the flyweights 12 and of the governor sleeve 13 when the engine is at a standstill. In the idling position LL indicated in FIGS. 4 and 5, this distance b is in actuality reduced virtually to zero.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A housed rpm governor for fuel-injected internal combustion engines, in particular a minimum-maximum speed governor of an injection pump for Diesel vehicle engines, having a governor lever coupled with a supply quantity adjusting member of said injection pump, said governor lever being actuatable both by a governor sleeve in accordance with rpm and further by an adjusting member which is pivotable for arbitrary variation of said supply quantity, said governor further having a force transmission lever arranged to rest on a stop means attached to said housing, said last named lever further being subjected to the initial stressing force of a primary governor spring and pivotable about a rotary axis attached to said housing and with which said governor member arrives at an operational state following the traversing of an idling path (a) of said governor sleeve effected counter to the force of at least two idling springs, the restoring force of said first idling spring being reinforced on one portion of said idling sleeve path (a) by means of a restoring force of said second idling spring, and wherein the exertion of force of at least one of said two idling springs is variable in accordance with the pivoted position of said adjusting member, characterized in that upon said adjusting member being pivoted out of the idling position into a partial-load position, the exertion of force of at least one of said two idling springs is increasable by means of a corrective adjusting member actuatable by said adjusting member in a sense to achieve a supply quantity which is progressively increased upon increasing load and a partial-load rpm which is regulated and increased with respect to said idling rpm.

2. A housed rpm governor for fuel-injected internal combustion engines, in particular a minimum-maximum speed governor of an injection pump for Diesel vehicle engines, having a governor lever coupled with a supply quantity adjusting member of said injection pump, said governor lever being actuatable both by a governor sleeve in accordance with rpm and further by an adjusting member which is pivotable for arbitrary variation of said supply quantity, said governor further having a force transmission lever arranged to rest on a stop means attached to said housing, said last named lever further being subjected to the initial stressing force of a primary governor spring and pivotable about a rotary axis attached to said housing and with which said governor member arrives at an operational state following the traversing of an idling path (a) of said governor sleeve effected counter to the force of said first idling spring being reinforced on one portion of said idling sleeve path (a) by means of a restoring force of said second idling spring, and wherein the exertion of force of at least one of said two idling springs is variable in accordance with the pivoted position of said adjusting member, characterized in that upon said adjusting member being pivoted out of the idling position into a partial-load position, the exertion of force of at least one of said two idling springs is increasable by means of a corrective adjusting member actuatable by said adjusting member in a sense to achieve a supply quantity which is progressively increased upon increasing load and a partial-load rpm which is regulated and increased with respect to said idling rpm, and said corrective adjusting member is coupled with said adjusting member via a connecting link and is adjustable in order to increase the initial spring stress of the first idling spring when said adjusting member has pivoted from said idling position into a partial-load position.

3. A housed rpm governor as defined by claim 2, characterized in that said corrective adjusting member has an adjusting cam supported on said force transmission lever, said adjusting cam being rotatable by means of an adjusting lever serving as part of said connecting link in accordance with the pivoted position of the adjusting member and is embodied as an adjustable spring abutment of said first idling spring.

4. A housed rpm governor as defined by one of the claims 2 or 3, characterized in that said connecting link further includes a guide pin arranged to engage an oblong slot guide in said adjusting lever which cooperates with said adjusting member.

5. A housed rpm governor for fuel-injected internal combustion engines, in particular a minimum-maximum speed governor of an injection pump for Diesel vehicle engines, having a governor lever coupled with a supply quantity adjusting member of said injection pump, said governor lever being actuatable both by a governor sleeve in accordance with rpm and further by an adjusting member which is pivotable for arbitrary variation of said supply quantity, said governor further having a force transmission lever arranged to rest on a stop means attached to said housing, said last named lever further being subjected to the initial stressing force of a primary governor spring and pivotable about a rotary axis attached to said housing and with which said governor member arrives at an operational state following the traversing of an idling path (a) of said governor sleeve effected counter to the force of said first idling spring being reinforced on one portion of said idling sleeve path (a) by means of a restoring force of said second idling spring, and wherein the exertion of force of at least one of said two idling springs is variable in accordance with the pivoted position of said adjusting member, characterized in that upon said adjusting member being pivoted out of the idling position into a partial-load position, the exertion of force of at least one of said two idling springs is increasable by means of a corrective adjusting member actuatable by said adjusting member in a sense to achieve a supply quantity which is progressively increased upon increasing load and a partial-load rpm, and in which said force transmission lever includes a guide lever connected with the governor member, said guide lever having opposite ends, one end being connected to said second idling spring and the other end of said lever being connected to said force transmission lever via a connecting member, characterized in that said connecting member is rotatable by said corrective adjusting member when said adjusting member is pivoted into the partial-load position actuated by said adjusting member and thereby shifts the effective range of the second idling spring, said second idling spring being switched into action position with decreasing rpm, in the direction of a higher supplemental rpm ($n_Z2$).

6. A housed rpm governor as defined by claim 5, characterized in that said connecting member comprises an extension of said corrective adjusting member.

7. A housed rpm governor as defined by claim 5 or 6, characterized in that said corrective adjusting member is secured against axial displacement and rotatably guided, inside a bearing bore which passes through said second idling spring.

8. A housed rpm governor as defined by claim 5 or 6, characterized in that said second idling spring cooperates with said corrective adjusting member and said corrective adjusting member is arranged to be supported in a guide bore in said force transmission lever.

9. A housed rpm governor as defined by one of the claims 5 or 6 in which said force transmission lever is arranged to support said second idling spring, said second idling spring further comprising a leaf spring means having an effective range fixed by a stop means supported on said connecting member, characterized in that said stop means includes a compound curve, said compound curve arranged to exert a predetermined stress on said guide lever whereby supplemental rpm ($n_Z$) may be controlled.

10. A housed rpm governor as defined by claim 1, characterized in that said corrective adjusting member is provided with a control slot, which is engaged by a coupler means secured to said adjusting member.

11. A housed rpm governor as defined by claim 10, characterized in that said control slot has a first control section arranged to shift the effective range of the second idling spring in the direction of a higher supplemental rpm ($n_Z2$) and an interconnected second control section arranged to hold the supplemental rpm ($n_Z2$) at least approximately constant.

12. An rpm governor as defined by claim 11, characterized in that said control slot further includes a third control section arranged to restore the rotary movement of the corrective adjusting member at least back as far as the idling position when the adjusting member has pivoted into the full-load position.

* * * * *